US005769621A

United States Patent [19]

Early et al.

[11] Patent Number: 5,769,621

[45] Date of Patent: Jun. 23, 1998

[54] LASER ABLATION BASED FUEL IGNITION

[75] Inventors: James W. Early, Los Alamos; Charles S. Lester, San Juan Pueblo, both of N. Mex.

[73] Assignee: The Regents of the University of California, Los Alamos, N. Mex.

[21] Appl. No.: 862,284

[22] Filed: May 23, 1997

[51] Int. Cl.[6] ..... F23B 11/04; F23C 11/04

[52] U.S. Cl. ..... 431/2; 431/1; 431/6; 431/258; 60/39.06; 60/261

[58] Field of Search ..... 431/2, 6, 1, 258; 60/39.06, 261

[56] References Cited

U.S. PATENT DOCUMENTS

| | | | |
|---|---|---|---|
| 3,427,118 | 2/1969 | Andress et al. | 431/258 |
| 3,473,879 | 10/1969 | Berberich | 431/1 |
| 4,035,131 | 7/1977 | Cerkanowicz | 431/6 |
| 4,302,933 | 12/1981 | Smith | 60/261 |
| 4,342,920 | 8/1982 | Bucknam | 123/46 E |
| 4,484,082 | 11/1984 | Bucknam | 290/1 R |
| 5,247,155 | 9/1993 | Steen et al. | 219/121.83 |
| 5,278,023 | 1/1994 | Bills et al. | 430/201 |
| 5,367,869 | 11/1994 | DeFreitas | 60/39.06 |

*Primary Examiner*—Larry Jones
*Attorney, Agent, or Firm*—Gemma Morrison Bennett

[57] ABSTRACT

There is provided a method of fuel/oxidizer ignition comprising: (a) application of laser light to a material surface which is absorptive to the laser radiation; (b) heating of the material surface with the laser light to produce a high temperature ablation plume which emanates from the heated surface as an intensely hot cloud of vaporized surface material; and (c) contacting the fuel/oxidizer mixture with the hot ablation cloud at or near the surface of the material in order to heat the fuel to a temperature sufficient to initiate fuel ignition.

14 Claims, 3 Drawing Sheets

LASER ABLATION BASED FUEL IGNITION

This invention was made with government support under Contract No. W-7405-ENG-36 awarded by the U.S. Department of Energy. The government has certain rights in the invention.

TECHNICAL FIELD

This invention relates to laser ignition of hydrocarbon fuels.

BACKGROUND ART

Laser light has been used to initiate the ignition of fuel/oxidizer mixtures for more than a decade. Recent developments have included laser induced ignition of liquid fuel aerosols to overcome problems with capacitive discharge ignitors. State of the art laser-based ignition processes use a laser-spark, air-breakdown ignition method in which a single, high peak power laser light pulse is used to initiate fuel ignition by generation of a high temperature, ionization plasma. Various types of short pulse length lasers operating from ultraviolet to infrared wavelengths have been employed in laser-spark, air-breakdown ignition methods. The successful use of laser-spark breakdown ignition method to reliably ignite fuel aerosols is limited to a narrow range of fuel parameters.

Therefore, there is still a need for reliable and energy efficient processes to initiate and sustain the ignition of gaseous and aerosol fuel/oxidizer mixtures.

It is an object of this invention to provide a process for ignition of gaseous and aerosol fuel/oxidizer mixtures.

It is another object of this invention to provide a reliable and energy efficient process for initiating and sustaining the ignition of gaseous and aerosol fuel/oxidizer mixtures by the application of laser light to a material surface.

It is a further object of this invention to provide a laser-ablation based fuel ignition process.

Additional objects, advantages and novel features of the invention will be set forth in part in the description which follows, and in part will become apparent to those skilled in the art upon examination of the following or may be learned by practice of the invention.

DISCLOSURE OF INVENTION

To achieve the foregoing and other objects, and in accordance with the purposes of the present invention, as embodied and broadly described herein, there has been invented a method of fuel/oxidizer ignition comprising: (a) application of laser light to a material surface which is absorptive to the laser radiation; (b) heating of the material surface with the laser light to produce a high temperature ablation plume which emanates from the heated surface as an intensely hot cloud of vaporized surface material; and (c) contacting the fuel/oxidizer mixture with the hot ablation cloud at or near the surface of the material in order to heat the fuel to a temperature sufficient to initiate fuel ignition.

BRIEF DESCRIPTION OF THE DRAWING

The accompanying drawings, which are incorporated in and form a part of the specification, illustrate some of the embodiments of the present invention and, together with the description, serve to explain the principles of the invention. In the drawings.

BEST MODES FOR CARRYING OUT THE INVENTION

Figure 1:
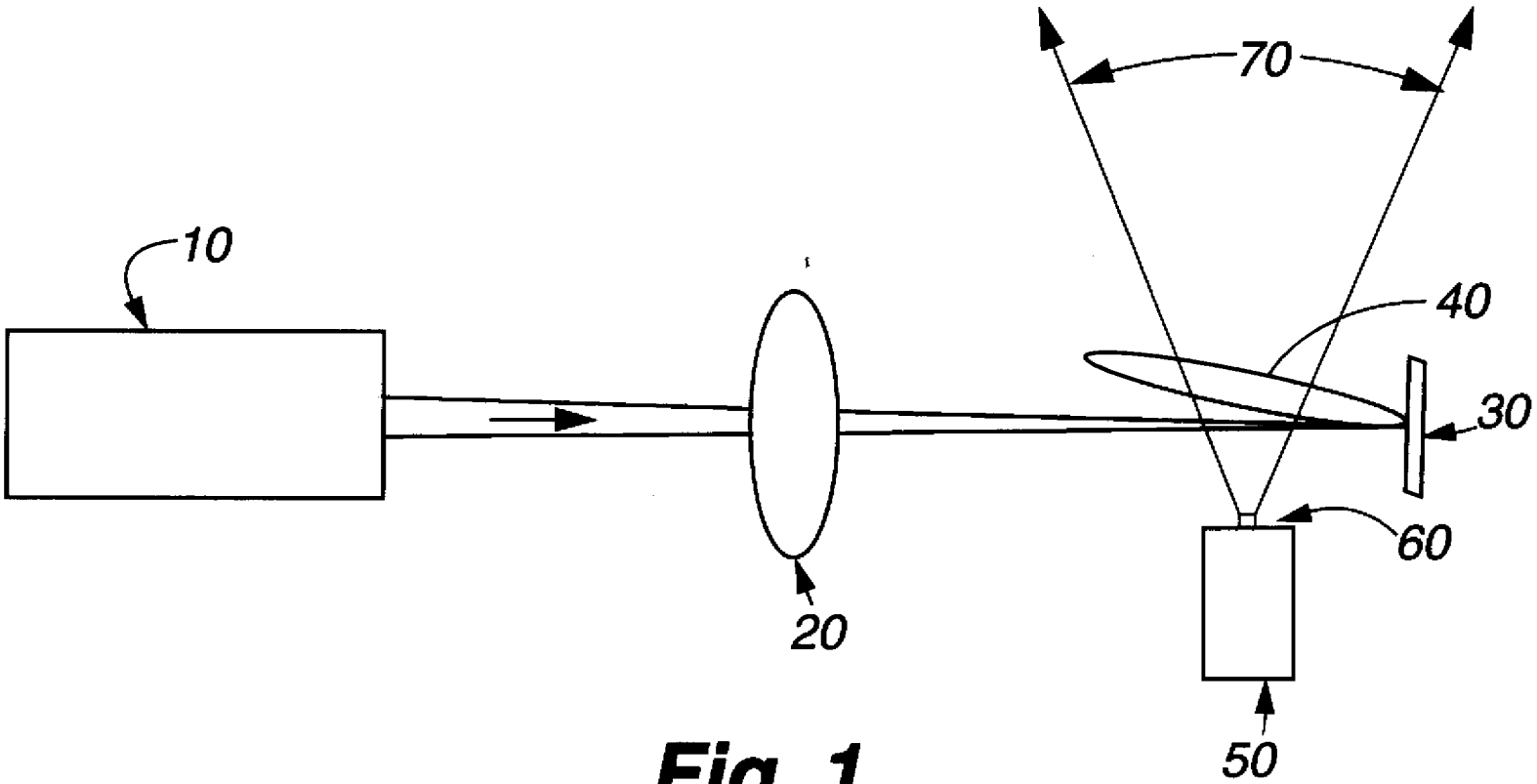
FIG. 1 is a schematic of a set-up for practice of the invention.

There has been discovered a method of fuel/oxidizer ignition comprising: (a) application of laser light to a material surface which is absorptive to the laser radiation; (b) heating of the material surface with the laser light to produce a high temperature ablation plume which emanates from the heated surface as an intensely hot cloud of vaporized surface material; and (c) contacting the fuel/oxidizer mixture with the hot ablation cloud, at or near the surface of the material in order to heat the fuel to a temperature sufficient to initiate fuel ignition.

The laser ablation based fuel ignition process of this invention provides a unique, reliable and energy efficient process to initiate and sustain the ignition of gaseous and aerosol fuel/oxidizer mixtures by the application of laser light to a material surface.

Gas or solid-state lasers which operate at wavelengths in the range of 0.19 to 11 microns can be effectively utilized for practice of this invention. Presently preferred is laser light at infrared wavelengths provided by Nd:YAG and Er:YAG solid-state lasers. Typically, only one laser light source is required for practice of the invention, although laser pulses from more than one laser can be employed.

The laser light source used for the practice of this invention may provide pulsed or continuous light output, although time averaged power requirement and target lifetime advantages are obtained from the use of pulsed laser radiation. The pulse length of the laser light pulse may extend from a few picoseconds to milliseconds in duration depending upon the optimal absorptive properties of the chosen target material. For example, pulse lengths in the range from about 10 ps to about 200 ns are generally considered useful when metallic targets are used. Pulse lengths in the range from about 10 ps to about 1 millisecond are generally believed useful when light absorptive, non-metallic materials are utilized as the ablative target.

The laser is adjusted for optimum results by first turning on a laser light source which provides light with a peak power and wavelength appropriate for the ablation of the type of target material to be utilized. The rate at which the fuel is to be ignited is obtained by adjusting the pulse repetition frequency of the laser output.

Laser light from the laser light source is directed to and centered upon a laser light focusing lens. The focusing lens is used to properly adjust the power density of the laser light at the target material surface to provide optimal vaporization of the target material surface in an aerosol cloud. Vaporization of surface layers in such an ablative process has been used for the purpose of dissipating extreme heat energy. In the present invention the heat transfer in the ablative process is used for ignition of a gaseous fuel, a fuel/oxidizer mixture or an aerosol fuel mixture.

A laser light absorptive target is inserted into the laser light at or near the focal point of the focusing lens. A target material is chosen so that the output pulse energy of the laser can be adjusted to a value sufficient to ablate the target material, providing a hot vaporization cloud. The surface of the laser light absorptive target may be oriented to obtain non-orthogonal incidence of the focused laser light, so that the generated ablation cloud may be directed appropriately into the fuel medium.

Suitable target materials are those which absorb laser light sufficiently to heat the target material to its boiling point, thereby causing vaporization of surface material and the production of a plume of hot gas. Target materials which will work in the practice of this invention include, but are not limited to, metals such as magnesium, aluminum, and alloys such as alloys of iron and cerium, as well as non-metallic materials such as graphite, amorphous carbon, boron, boron carbide, boron nitride and silicon carbide. The configuration of target materials may be bulk materials or may be coatings of ablative material upon a non-volatile substrate such as silica or glass through which laser light may be transmitted. The size, shape and surface texture of the target material is of secondary importance to other parameters such as fuel mix, output pulse energy of laser, velocity of fuel flow, and choice of target material.

The fuel/oxidizer mixture to be ignited is introduced into the region at or near the target surface so that it is intercepted by the hot gases produced by the laser induced vaporization process. Optimal ignition performance for the specific fuel/oxidizer mixture is obtained by adjusting the pulse peak power obtained from the laser. Typically the laser peak power is adjusted by varying the laser pulse energy by either increasing or decreasing the laser excitation energy. Alternatively, the laser peak power can be adjusted by varying the laser pulse duration.

Fuels which can be ignited using the methods of this invention include, but are not limited to, hydrocarbon fuels such as gaseous fuels or fuels which can be vaporized such as heating oil, kerosene, diesel, or jet fuels.

Unlike conventional laser-spark induced fuel ignition, in which only a small volume within the fuel cloud (typically $<10^{-4}$ $cm^3$) is heated by the laser light, the laser ablation technique produces a spatially expansive volume of hot gas (typically several cubic centimeters) which encompasses a large fraction of the fuel cloud volume. This involvement of a larger portion of the fuel cloud eliminates many of the local fuel parameter related problems experienced with conventional laser spark ignition, such as the problems associated with proximity of the heated volume to the fuel droplets and dwell time in which the fuel droplet is in contact with the laser heated gas. The result is an enhanced fuel ignition performance and insensitivity to local fuel parameters such as droplet size, number density and velocity.

Employing the methods of this invention enables use of much lower peak power laser light to induce an ignition plasma than is required for the state-of-the-art laser-spark breakdown ignition methods. Typically, peak laser power requirements are reduced by better than three orders of magnitude with respect to that needed to induce air breakdown. Use of lower peak power laser light reduces laser size and complexity and greatly facilitates the transport of laser light through optical fibers for an actual laser ignition application.

The spatial dimensions of the hot vaporization plume are large enough to encompass and heat a large fraction of the fuel aerosol cloud, unlike the case for the state-of-the-art laser-induced spark ignition and other laser-based methods in which only a small volume (several cubic millimeters) of the fuel aerosol is heated. Heating a large fraction of a fuel aerosol cloud reduces sensitivity to local fuel composition and ensures consistent, reliable ignition.

FIG. 1 shows a schematic of a set up for practice of a typical embodiment of the invention. With reference to FIG. 1, a laser light source 10 is positioned so that laser beams from the laser light source are focused through a 5 to 50 cm focal length lens 20 onto a selected target material 30. An ablation cloud 40 is formed from the vaporized surface target material. The ablation cloud is emitted from the material surface at a near 90° angle regardless of the angle of incidence of the laser light upon the target surface. Typically, the target material is oriented so that the ablative plume intercepts the fuel cloud at normal incidence to the direction of fuel flow, although this is not the only orientation for the ablative plume which will provide ignition of the fuel. Various incidence angles of the laser light onto the ablative surface and various orientations of the resulting vaporization plume to the direction of fuel flow can be effectively implemented.

To extend the useful lifetime of the target, successive regions of a spatially extensive target surface are contacted by the ablative light. Contacting of successive regions of the target can be accomplished by either moving the target with respect to the focal point of the ablative light or by moving the focal point of the ablative light upon the target. A simply X-Y translation of the focusing lens can be used to accomplish the latter approach. By sequentially contacting successive regions of the target, a target with a surface area of 1 $cm^2$ and a thickness of 1.0 cm can provide over 6500 fuel ignitions before requiring replacement.

Figure 2:
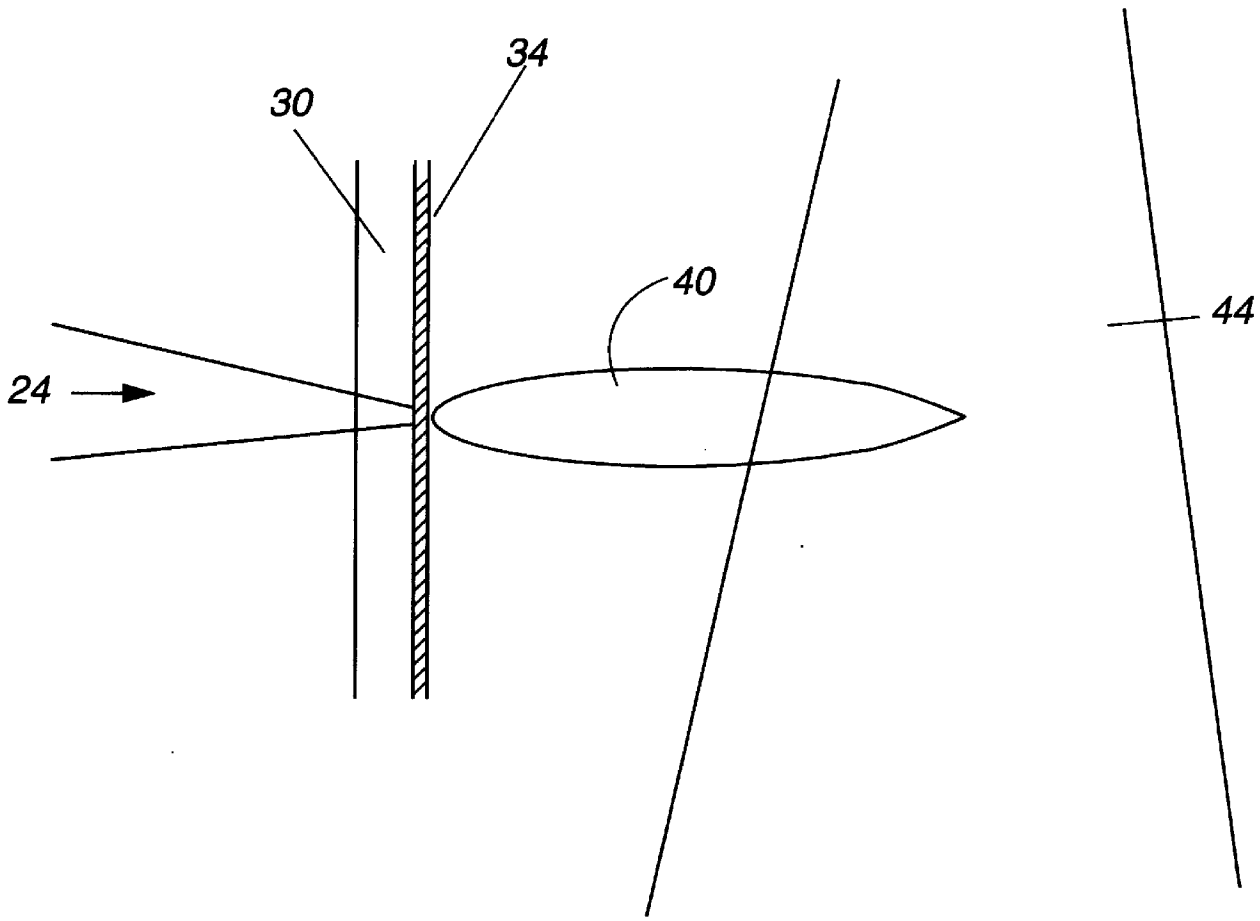
FIG. 2 is a schematic of a set-up for practice of another embodiment of the invention.

In another embodiment of the invention, shown in FIG. 2, ablative material 34 can be coated upon a light transmissive target substrate 30 so that vaporization inducing light 24 incident upon the uncoated side of the target substrate 30 will produce a vaporization of material 40 from the opposite side of the target substrate 30. The coating material can be introduced into the fuel containment region 44 as a component of the fuel which coats out onto the opposite surface of the target substrate 30.

Figure 3:
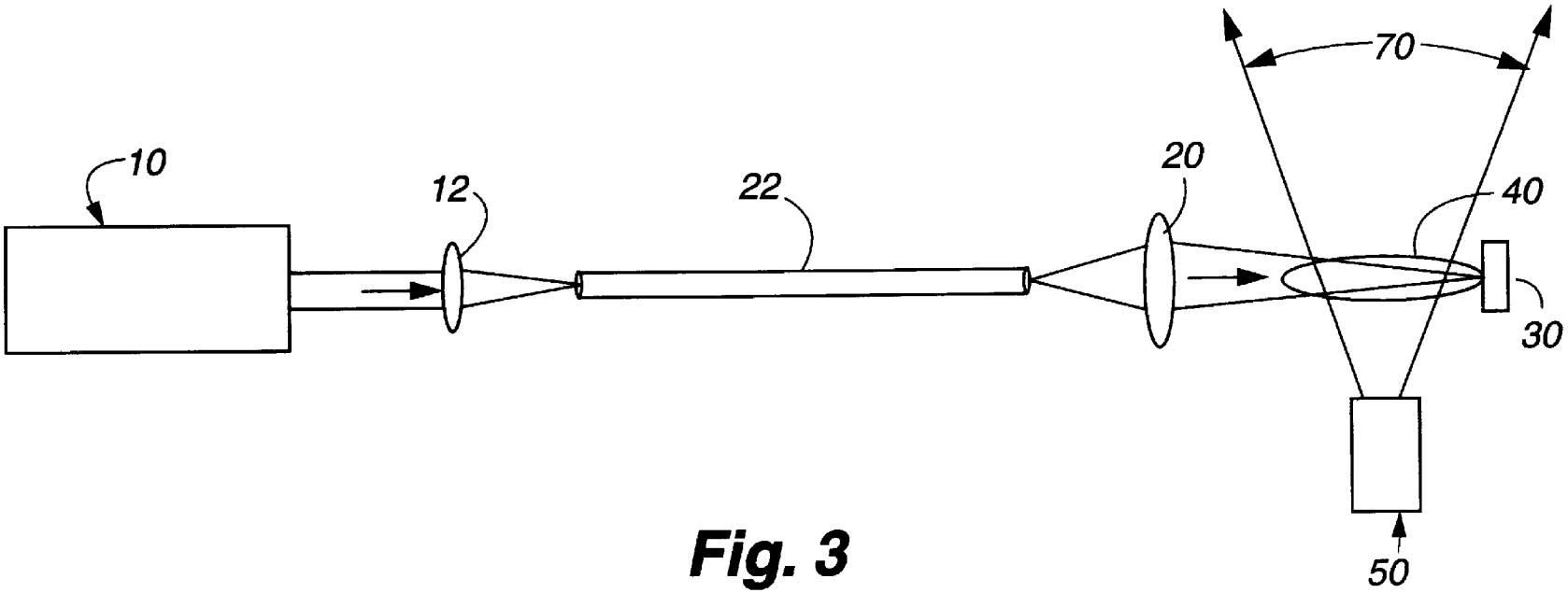
FIG. 3 is a schematic of a set-up of an third embodiment for practice of the invention.

In a third embodiment of this invention, a laser producing long pulse length, low peak power ablating light may be remotely located with respect to the light focusing lens. With reference to FIG. 3, in this embodiment, the light output of the laser 10 may be injected using a short focal length lens 12 into an optical fiber 22 and transported to the focusing lens 20 located near the fuel zone to be ignited 70. For this embodiment, solid core optical fiber composed of a material providing low transport loss at the operating wavelength of the laser, such as Z-Blan for the case of 2.94 micron ablative light or metallized hollow core optical fibers, is particularly useful.

The methods of this invention provide enhanced performance for the ignition of fuels which are difficult to light, such as jet fuel aerosols, compared to the state-of-the-art, laser-based fuel ignition methods consisting of laser spark breakdown mechanisms.

The methods of this invention have been successfully used to ignite jet fuel aerosols generated by a commercial turbo-jet, forced-air atomizer with 100% reliability at modest laser energy.

The following examples demonstrate operability of the invention.

EXAMPLE I

Several runs were made to demonstrate use of low peak power, long duration laser light pulses for ignition of Jet A fuel using several different target materials. The ability of a laser-induced vaporized cloud to initiate fuel combustion was evaluated. Equipment was set up as shown in FIG. 1.

A solid state Schwartz-Electrooptics model 1-2-3 Er:YAG laser 10 was operated at a wavelength of 2.94 microns in the free-running mode, providing 400 mJ of laser pulse energy at a 1 Hz rate. Laser light pulses of 120 microsecond duration FWHM were used. A multiple transverse spatial mode was used for these runs.

Emitted laser light was directed to a fused silica lens 20 for efficient transmission of the selected wavelength of light. The lens had a 0.5 meter focal length and was used to focus the laser light to a spot size diameter of about 1.0 mm at the focal plane of the lens.

Targets 30 composed of materials which would efficiently absorb the 2.94 micron laser light were placed at the focal point of the focusing lens. In each run, the surface of the target was oriented to provide near normal incidence of the focused laser light relative to the plane of the target surface.

Jet A fuel aerosol produced by a forced-air fuel injector 50 of a type commonly used in commercial turbo-jet aircraft was used for the runs of this example. To ignite the fuel, the fuel injector nozzle 60 was located adjacent to the laser ablation target 30 as shown in FIG. 1 in a manner which permitted the laser-induced vaporization plume to intercept the fuel cloud. Typically, the ablative target 30 was placed 1.0 cm away from the face of the fuel injector nozzle 60 and 1.0 cm from the center of the nozzle in the lateral direction away from the laser.

A typical result of the runs made in this example was a bright vaporization plume generated by the interaction of the laser light with target material intercepting the fuel flow from the injection nozzle. The subsequent ignition of the entire fuel cloud was induced by the laser generated vaporization cloud in each trial.

The best performance with respect to the degree of material vaporized and the spatial extent of the vaporization plume generated was obtained using graphite (carbon) targets and iron/cerium alloy targets. At the laser operating conditions used in the runs of this example, a white-hot, incandescent plume of vaporized material which extended several centimeters from the target surface was generated. The vapor plume emanated from the target surface at a 90 degree angle to the plane of the target surface.

The removal of target material by ablation with each laser shot was estimated to be 0.15 $mm^3$. For a target of 1 cm thickness, approximately 50 fuel igniting laser shots were obtained before the entire thickness of target material was consumed.

Consistent, 100% reliable ignition of the fuel aerosol was produced with each laser pulse.

EXAMPLE II

A second set of runs were made to evaluate the fuel ignition performance of the laser ablation technique of this invention using a shorter duration, higher peak power, Q-switched laser light. The equipment was set up in a manner identical to that used for the runs in Example I.

A Laser Photonics model YQL-102 Q-switched Nd:YAG laser was operated at a wavelength of 1064 nm. The laser produced short duration light pulses (12 ns FWHM) at a 1 Hz rate. The laser was also operated with a multiple transverse spatial mode and a pulse energy of 100 mJ. Light emitted from the laser was directed to a 15 cm focal length silica lens. The silica lens provided a ~100 micron diameter laser spot at the lens focal plane where the ablative target material was placed.

Metal target materials tested were aluminum, magnesium and an iron/cerium alloy. Non-metal target materials tested were graphite (carbon) and silicon carbide.

In the runs of this example, jet fuel aerosols were consistently ignited utilizing each of the target materials. In general, the shorter duration laser light produced less spatially extensive vaporization clouds than those observed in the runs of Example I, which were typically several centimeters in length.

EXAMPLE III

A third set of runs was made to evaluate the ignition performance of the invention method using gaseous fuels. The equipment and procedure was the same as that used for the runs of Example II with the exception that a bunsen burner assembly for the delivery of gaseous fuel was substituted for the fuel spray nozzle.

A Laser Photonics model YQL-102 Q-switched Nd:YAG laser was used to provide the fuel igniting laser light. A bunsen burner-like apparatus was used to produce a methane/air fuel mixture for the laser induced ignition tests.

A laser energy of 80 mJ/pulse was used in the runs of this example.

A broad range of fuel compositions ranging from 1.0 to 0.6 stoichiometric fuel/air mixtures was tested.

Graphite was used as the laser ablative target material for the runs of this example. A shorter, 10 cm focal length lens was used to focus the output of the Nd:YAG laser onto the graphite target.

In the runs of this example, reliable fuel ignition was achieved with each shot of the laser over the broad range of fuel composition from 1.0 to 0.6 stoichiometric fuel/air mixtures.

While the methods and apparatuses of this invention have been described in detail for the purpose of illustration, the inventive methods and apparatuses are not to be construed as limited thereby. This patent.is intended to cover all changes and modifications within the spirit and scope thereof.

INDUSTRIAL APPLICABILITY

The methods and apparatuses of this invention can be used for reliable ignition of hydrocarbon fuels such as gaseous fuels or fuels which can be vaporized such as heating oil, kerosene, diesel, or jet fuels.

What is claimed is:

1. An ignition method comprising:

(a) application of laser light to a material surface which is absorptive to laser radiation;

(b) heating of said material surface with light from said laser to produce a high temperature ablation plume which emanates from said surface as an ablation cloud of vaporized surface material; and (c) contacting said ablation cloud at or near said surface of said material with a fuel in order to heat said fuel to a temperature sufficient to initiate fuel ignition.

2. A method as recited in claim 1 wherein said fuel is a fuel/oxidizer mixture.

3. A method as recited in claim 1 wherein said target material is graphite.

4. A method as recited in claim 1 wherein said target material is an alloy of cerium and iron.

5. A method as recited in claim 1 wherein said laser light has a wavelength in the range from about 0.19 microns to about 11 microns.

6. A method as recited in claim 1 wherein said laser light is a pulsed laser light having a pulse length in the range from about 10 picoseconds to about 200 nanoseconds.

7. An ignition method comprising:

(a) application of laser light to a target material having a surface which is absorptive to laser radiation;

(b) heating of said absorptive surface with light from said laser to produce an ablation plume which emanates from the opposite surface of said target material as an ablation cloud of vaporized surface material; and (c) contacting said ablation cloud at or near said opposite surface of said material with a fuel in order to heat said fuel to a temperature sufficient to initiate fuel ignition.

8. A method as recited in claim 7 wherein said opposite surface is coated with an ablative material.

9. A method as recited in claim 8 wherein said ablative material is a component of said fuel.

10. A method as recited in claim 8 wherein said ablative material is graphite.

11. A method as recited in claim 8 wherein said ablative material is an alloy of cerium and iron.

12. A method as recited in claim 7 wherein said fuel is a fuel/oxidizer mixture.

13. A method as recited in claim 7 wherein said laser light has a wavelength in the range from about 0.19 microns to about 11 microns.

14. A method as recited in claim 7 wherein said laser light is a pulsed laser light having a pulse length in the range from about 10 picoseconds to about 200 nanoseconds.

* * * * *